US012729027B2

(12) United States Patent
Buckel et al.

(10) Patent No.: US 12,729,027 B2
(45) Date of Patent: Sep. 8, 2026

(54) PACKAGING MACHINE WITH A SYSTEM FOR DETECTING A PACKAGING ELEMENT

(71) Applicant: Syntegon Technology GmbH, Stuttgart (DE)

(72) Inventors: Daniel Buckel, Langfurth (DE); Tim Fleckenstein, Vellberg (DE)

(73) Assignee: Syntegon Technology GmbH, Stuttgart (DE)

( * ) Notice: Subject to any disclaimer, the term of this patent is extended or adjusted under 35 U.S.C. 154(b) by 0 days.

(21) Appl. No.: 19/352,779

(22) Filed: Oct. 8, 2025

(65) Prior Publication Data

US 2026/0116608 A1 Apr. 30, 2026

(30) Foreign Application Priority Data

Oct. 31, 2024 (DE) ..... 10 2024 131 911.9

(51) Int. Cl.

| | |
|---|---|
| ***B65B 57/04*** | (2006.01) |
| ***B65B 3/00*** | (2006.01) |
| ***B65B 61/26*** | (2006.01) |
| ***B65B 65/00*** | (2006.01) |

(52) U.S. Cl.

CPC ..... *B65B 57/04* (2013.01); *B65B 3/006* (2013.01); *B65B 61/26* (2013.01); *B65B 65/003* (2013.01)

(58) Field of Classification Search

CPC ..... B65B 57/04; B65B 3/006; B65B 61/26; B65B 65/003

See application file for complete search history.

(56) References Cited

U.S. PATENT DOCUMENTS

| | | | | |
|---|---|---|---|---|
| 4,859,862 | A | 8/1989 | Planke et al. | |
| 12,577,014 | B1 * | 3/2026 | Davis | B26D 5/007 |
| 2010/0013500 | A1 | 1/2010 | Maher et al. | |

(Continued)

FOREIGN PATENT DOCUMENTS

| | | | | |
|---|---|---|---|---|
| CN | 104550051 | A | 4/2015 | |
| CN | 106742281 | A * | 5/2017 | B65G 61/00 |

(Continued)

OTHER PUBLICATIONS

German Patent Office Action for Application No. 102024131911.9 dated May 9, 2025 (9 pages including English translation).

*Primary Examiner* — Lucas E. A. Palmer
(74) *Attorney, Agent, or Firm* — Michael Best & Friedrich LLP

(57) ABSTRACT

A packaging machine includes at least one system for detecting the presence and/or absence and/or position of a first packaging element in a packaging machine. The machine includes a profile sensor configured to detect a profile representative of the presence and/or absence and/or position of the first packaging element, and a control unit configured to evaluate the profile detected by the profile sensor and provide at least one piece of information concerning the presence and/or absence and/or position of the first packaging element. The packaging machine includes at least one holding element for holding the first packaging element, and/or a sliding element for moving the first packaging element, wherein a contour of the holding element and/or a contour of the sliding element is part of the profile.

14 Claims, 5 Drawing Sheets

(56) References Cited

U.S. PATENT DOCUMENTS

| | | | | |
|---|---|---|---|---|
| 2013/0278927 | A1 | 10/2013 | Johnson et al. | |
| 2014/0001073 | A1* | 1/2014 | Kim | B65B 43/54 53/471 |
| 2014/0157732 | A1* | 6/2014 | Gasber | B65B 25/008 53/235 |
| 2015/0225104 | A1* | 8/2015 | Reed | B65B 61/26 156/60 |
| 2015/0274436 | A1* | 10/2015 | Di Donna | B65B 57/04 414/751.1 |
| 2016/0137426 | A1 | 5/2016 | Itoh et al. | |
| 2021/0383521 | A1* | 12/2021 | Wilson | B31B 50/26 |
| 2022/0234776 | A1* | 7/2022 | Ohura | B65B 9/045 |
| 2023/0054647 | A1* | 2/2023 | Martins De Vasconcelos | B65B 11/004 |
| 2024/0109103 | A1* | 4/2024 | Kumar | B07C 5/342 |
| 2024/0400248 | A1* | 12/2024 | Ross, II | B65B 61/26 |
| 2025/0187352 | A1* | 6/2025 | Cyman | B65G 47/53 |
| 2025/0282512 | A1* | 9/2025 | Lin | B65B 43/52 |

FOREIGN PATENT DOCUMENTS

| | | | | | |
|---|---|---|---|---|---|
| CN | 120517667 | A | * | 8/2025 | B65B 59/001 |
| DE | 102013104666 | A1 | | 11/2014 | |
| DE | 102016124400 | A1 | | 6/2018 | |
| DE | 202017107845 | U1 | | 1/2019 | |
| KR | 20000074235 | A | * | 12/2000 | B65B 43/48 |
| WO | WO-2021188676 | A1 | * | 9/2021 | B65B 61/22 |

* cited by examiner

PACKAGING MACHINE WITH A SYSTEM FOR DETECTING A PACKAGING ELEMENT

BACKGROUND

The invention relates to a packaging machine with a system for detecting the presence and/or absence and/or position of a first packaging element in the packaging machine, and a method for triggering a rejection process in the packaging machine.

When sealing packaging filled with a pharmaceutical product or a food product, it must be ensured that the packaging elements used for this purpose are connected to each other in accordance with specifications and that the packaging is therefore properly sealed. Improperly sealed packaging can, for example, cause the pharmaceutical product or food product contained therein to spoil. Leakage of the pharmaceutical product or food product from the packaging can also pose a health risk to the consumer. Therefore, improperly sealed packaging is separated out after the packaging process.

In order to avoid separating out packaging that has already been filled with the pharmaceutical product or food product, it is advantageous to detect at an early stage during the packaging process whether the packaging can be sealed properly at all. It is also advantageous to detect at an early stage after sealing whether the packaging is properly sealed. This can protect the plant operator, for example, when processing highly potent pharmaceutical products that may pose a health risk to the plant operator.

It is known from the prior art that a camera system can be used to detect the presence and position of a packaging element. However, such camera systems are associated with high costs, which is why in practice they are often not used, thereby accepting a higher health risk for the plant operator. Such camera systems also have the disadvantage that detection errors may occur due to reflections in the packaging machine or extraneous light.

In addition to camera systems, the prior art also includes the use of individual sensors to detect the incorrect position of a packaging element. When using such individual sensors, different format parts are required for their installation in the packaging machine in order to be able to use the packaging machine for different packaging types, packaging sizes and packaging shapes. This results in increased effort for maintaining and converting the format parts. In addition, such individual sensors must be mounted at a short distance above the packaging elements, which can result in turbulence in the laminar air flow that usually prevails there.

SUMMARY

Proceeding from this basis, the object of the present invention is to at least partially solve the problems described with reference to the prior art and, in particular, to specify a system and a method for identifying, in a simple and cost-effective manner, packaging that cannot be properly sealed and/or is not properly sealed.

This object is achieved by a packaging machine and a method according to the features of the disclosure. Further advantageous embodiments are specified in the description and, in particular, in the description of the figures. It should be noted that a person skilled in the art can combine individual features in a technologically sensible manner and thus arrive at further embodiments of the invention.

Described here is a packaging system with at least one system for detecting the presence and/or absence and/or position of a first packaging element in a packaging machine, comprising a profile sensor which is designed to detect a profile representative of the presence and/or absence and/or position of the first packaging element, and a control unit which is designed to evaluate the profile detected by the profile sensor and, based on this, provide at least one piece of information concerning the presence and/or absence and/or position of the first packaging element, wherein the packaging machine comprises at least one holding element for holding the first packaging element, and/or a sliding element for moving the first packaging element, wherein a contour of the holding element and/or a contour of the sliding element is part of the profile.

The profile sensor is an optical sensor, designed in particular as a laser scanner. A sensor signal emitted by the profile sensor, in particular a transmitting unit of the profile sensor, is reflected from surfaces of packaging elements and components of the packaging machine and received by the profile sensor, in particular a receiving unit of the profile sensor. The receiving unit is arranged at a defined distance and angle to the transmitter unit on the profile sensor. The profile sensor works with the light section method and is thus based on the principle of triangulation, which enables high measuring accuracy and high detection reliability. The measuring accuracy of such a profile sensor is, in particular, independent of the respective material and colour of the packaging element or component and of the distance between the profile sensor and the packaging element or component. Profile sensors usually have a compact design and are comparatively inexpensive. In addition, a profile sensor allows a high measuring speed and, unlike a camera, is not susceptible to extraneous light.

The profile, also known as the height profile, is detected by the profile sensor by "measuring" the shortest distance between the profile sensor and the packaging element and/or component at a large number of measuring points where the sensor signal hits a packaging element and/or the component of the packaging machine. This makes it possible, for example, to detect the shape of the packaging element and/or component and—depending on the resolution of the profile sensor—the surface texture of the packaging element and/or component and to map this in the profile. The shape or surface texture contained in the profile substantially corresponds to the actual shape or surface texture, although deviations are possible, for example due to the resolution of the profile sensor.

The expression "representative of the presence and/or absence and/or position of the first packaging element" means, in the context of the present application, that the profile does not necessarily have to include the first packaging element itself. However, the profile must allow conclusions to be drawn about the presence and/or absence and/or position of the first packaging element.

The control unit is preferably arranged separately from the profile sensor and may be a higher-level control unit, for example of a packaging machine, or at least embedded therein. The control unit is connected to the profile sensor via a data connection, through which the control unit can receive data from the profile sensor. This data is used for evaluation by the control unit.

An evaluation by the control unit may include a comparison of data recorded by the profile sensor and transmitted to the control unit with data stored in the control unit, in particular a memory unit of the control unit.

The information provided may, for example, include that a first packaging element stored as present is actually present and/or that a first packaging element stored as absent is actually absent and/or that an (actual) position of the at least one present first packaging element corresponds to a stored (target) position and/or the extent to which the (actual) position of the at least one present first packaging element deviates from the stored (target) position.

Different arrangements of several first packaging elements and/or dimensions and/or types and/or shapes of the first packaging element can be stored in the control unit, in particular in a memory unit of the control unit. A corresponding adjustment can thus be made by simply specifying this to the control unit, so that with the system according to the invention, it is not necessary to keep different format parts in stock or to convert equipment, as is the case when using individual sensors.

The packaging machine with the system according to the invention thus provides a simple and cost-effective means of identifying packaging that cannot be closed properly and/or is not closed properly.

In a particularly advantageous manner, the first packaging element is a closure element, preferably a stopper.

Such a closure element can be used to close a second packaging element, for example a container, in particular a vial, a cartridge or a (disposable) syringe. The closure element has a cylindrical shape in particular, but may also have any other shape, for example that of a cuboid. The closure element may have steps and/or a meandering structure on a surface adjacent to the second packaging element when attached. The closure element may be at least partially hollow. The closure element is made of an elastic plastics material in particular.

Advantageously, a contour of the first packaging element is part of the profile.

The contour of the first packaging element contained in the profile substantially corresponds to an actual contour of the first packaging element that can be detected by the profile sensor, wherein deviations may occur as described above. The contour comprises, in particular, a surface of the first packaging element facing the profile sensor, in particular an end face. The first packaging element may have a further contour or further contours which, for example, face away from the profile sensor or are concealed by a further packaging element or a component of the packaging machine and are therefore not detectable by the profile sensor.

In the context of this application, "part of the profile" means that at least one area or portion or fragment of the profile is the contour of the packaging element. Alternatively, the profile may also be without a contour of the first packaging element. This is particularly the case if the first packaging element is covered by a component of the packaging machine, for example the sliding element described below, in such a way that the profile sensor cannot detect any contour of the first packaging element.

In a preferred variant, the profile sensor is a 2D profile sensor and a sensor signal emitted by the profile sensor is linear.

The profile sensor is then preferably set up in such a way that it can detect a profile that is representative of the presence and/or absence and/or position of several first packaging elements, which are preferably arranged in a row next to each other.

The linear sensor signal is, in particular, a laser line. The profile detected by the profile sensor is, in particular, a linear profile or a profile line. A movable 2D profile sensor can also be used to detect a flat profile or a profile surface.

In a further preferred variant, the profile sensor is a 3D profile sensor and a sensor signal emitted by the profile sensor is multi-line, preferably grid-shaped.

The profile sensor is then preferably set up in such a way that it can detect a profile that is representative of the presence and/or absence and/or position of several first packaging elements, which are preferably arranged in a multi-row pattern.

The multi-line sensor signal comprises, in particular, a plurality of laser lines arranged next to one another, which may intersect. Preferably, several laser lines arranged next to each other are arranged in a first direction and further several laser lines arranged next to each other are arranged in a second direction at an angle to the first direction, wherein the laser lines of the first direction intersect the laser lines of the second direction, so that the sensor signal emitted by the profile sensor is a grid-shaped sensor signal. The profile detected by the profile sensor is a flat profile or a profile surface, wherein the 3D profile sensor does not need to be moved to detect such a profile.

In the following details regarding the packaging machine are described. A holding element for holding the first packaging element is preferably arranged for laterally holding the first packaging element. A sliding element for sliding the first packaging element is arranged preferably arranged for sliding the first packaging element into a second packaging element.

The packaging machine is used to seal packaging filled with a pharmaceutical product, in particular a liquid pharmaceutical product, or a food product. The system according to the invention is used to identify packaging that cannot be sealed properly and/or is not sealed properly.

The profile sensor can be set up to detect the holding element and, if applicable, the first packaging element arranged therein. Alternatively or additionally, the profile sensor can be set up to detect the sliding element. In this context, the term "set up" means that the profile sensor is arranged and aligned in the packaging machine in such a way that it detects the holding element and/or the sliding element. If both the holding element and the sliding element are to be detected, two independent profile sensors are preferably used for this purpose.

The contour of the holding element and/or the sliding element contained in the profile substantially corresponds to an actual contour of the holding element and/or the sliding element that can be detected by the profile sensor, wherein deviations may occur as described above. In particular, the contour comprises a surface of the holding element and/or the sliding element facing the profile sensor. The holding element and/or the sliding element may each have one or more additional contours which, for example, face away from the profile sensor or are covered by a packaging element or another component of the packaging machine and are therefore not detectable by the profile sensor. "Part of the profile" also means here that at least one area or portion or fragment of the profile is the contour of the packaging element.

The holding element has at least one receptacle, which serves to hold the first packaging element. The contour of the holding element is determined in particular by a surface adjacent to the at least one receptacle. If the first packaging element is arranged in such a receptacle, the profile is determined by the contour of the first packaging element and the contour of the surface adjacent to the at least one first packaging element. The holding element preferably has several receptacles so that the holding element can preferably be equipped with several first packaging elements. The receptacles are then preferably arranged in a row next to each other. The first packaging element is preferably pressed into the respective receptacle along a central axis running through the receptacle. The holding element can, for example, be designed as a stopper fork, which can accommodate first packaging elements designed as stoppers.

An (actual) profile, which comprises a contour of the holding element with its receptacles and a contour of the first packaging element arranged therein, if applicable, can be compared with a (target) profile stored in the control unit, in particular in a memory unit of the control unit. Such a comparison can be used, for example, to determine whether a first packaging element stored as present is actually present in a receptacle of the holding element and/or whether a first packaging element stored as absent is actually absent and/or whether the (actual) position of the at least one present first packaging element in a receptacle of the holding element corresponds to the stored (target) position and/or to what extent the (actual) position deviates from the stored (target) position.

At least one reference surface is preferably defined on the holding element, preferably on the surface adjacent to the at least one receptacle, and can be detected by the profile sensor and is preferably stored in the control unit, in particular in its memory unit. The at least one reference surface is defined in particular on an intermediate piece or web between two receptacles of the holding element or on an end piece of the holding element adjacent to a receptacle.

The at least one reference surface serves, for example, to determine a distance or height between a surface on the first packaging element, in particular an end surface of the first packaging element, and the reference surface on the holding element. The at least one reference surface can then be used by the control unit when evaluating the (actual) profile, for example to determine an (actual) distance between the reference surface on the holding element and the surface on the first packaging element. In this way, for example, the (actual) position of a packaging element that is present can be determined. The at least one reference surface can also be used when defining the stored (target) profile to define a maximum (target) distance and/or minimum (target) distance between the reference surface and the surface on the first packaging element. The (target) distance is also referred to as the reference height. A reference window is defined between the maximum (target) distance and the minimum (target) distance, in which the first packaging elements must be arranged so that their (actual) position can be found to be correct in particular.

For example, when sealing a package consisting of a container designed as a second packaging element and a closure element designed as a first packaging element, which is to be inserted into the container, the described system can be used to check whether the closure element protrudes too far from the holding element. Such protrusion from the holding element promotes a skewed position of the closure element, which can impair or even prevent the insertion of the closure element into the container.

The sliding element, which is designed, for example, as a plunger, in particular as a stopper plunger, can be arranged in relation to the first packaging element, or the first packaging element can be arranged in relation to the sliding element, in such a way that the first packaging element is at least partially concealed from the profile sensor by the sliding element. The expression "at least partially covered" means in this case that the first packaging element cannot be detected by the profile sensor, or can only be detected partially. This is particularly the case when the sliding element is arranged between the profile sensor and the first packaging element. The profile sensor then detects a contour of the sliding element with the first packaging element arranged underneath it, i.e. on a side of the sliding element facing away from the profile sensor, wherein the first packaging element rests in particular against the sliding element.

The detectable contour of the sliding element comprises, in particular, an end face of the sliding element. The contour of the sliding element, which is part of the profile, is representative of the presence and/or absence and/or position of the first packaging element, since the presence and/or absence and/or position of the first packaging element has an effect on a position of the sliding element. During evaluation by the control unit, the presence and/or absence and/or position of the first packaging element can then be determined indirectly, taking into account the part of the profile that is generated by the contour of the sliding element.

An (actual) profile comprising a contour of the sliding element can be compared with a (target) profile stored in the control unit, in particular in a memory unit of the control unit. Such a comparison makes it possible, for example, to determine whether a first packaging element stored as present is actually present and/or whether a first packaging element stored as absent is actually absent and/or whether the (actual) position of the at least one present first packaging element corresponds to the stored (target) position and/or to what extent the (actual) position of the at least one present first packaging element deviates from the stored (target) position.

The principle described herein of representing the presence and/or absence and/or position of the first packaging element by means of the sliding element can be transferred to any other component of a packaging machine which at least partially covers the first packaging element and on which the presence and/or absence and/or position of the first packaging element has an effect, wherein the first packaging element in particular rests against the component.

The packaging machine may have a nest for receiving second packaging elements, in particular containers, in particular vials, cartridges or (disposable) syringes. The nest preferably has nest receptacles arranged in a row or in several rows, in which the second packaging elements can be arranged.

In addition or alternatively, the packaging machine may comprise a supply unit for supplying first packaging elements. The holding element is then designed in particular to receive the first packaging element at the supply unit and, preferably by means of a kinematic mechanism and in particular in a pivoting movement, to move it to the nest, in particular over a second packaging element arranged in the nest. The holding element is movable from a pick-up position to a delivery position. At the supply unit and in the pick-up position of the holding element, the first packaging element is preferably pressed into a receptacle of the holding element from below. In particular, several first packaging elements are picked up by the holding element, preferably simultaneously. The holding element is then moved to the delivery position, whereby the first packaging element is placed over the second packaging element, which is located in the nest. In the delivery position of the holding element, the first packaging element is pushed out of the holding element and into the second packaging element, preferably by means of the sliding element.

The packaging machine is preferably also used to fill the packaging, in particular the second packaging element, with a pharmaceutical product or a food product and can therefore additionally or alternatively have a filling unit for filling the second packaging elements, preferably at a filling station of the packaging machine. The filling unit is attached in particular to a free end of a robot arm and can be arranged above the second packaging elements, which are arranged in particular in the nest, in order to fill the second packaging elements. The filling unit has in particular several filling elements, which are preferably arranged in a row next to each other.

The control unit of the system according to the invention can be a higher-level control unit of the packaging machine or at least embedded therein. In addition to different arrangements and/or dimensions and/or types and/or shapes of the first packaging element, different reference surfaces, for example, can also be stored in the control unit, in particular in a memory unit of the control unit.

It is advantageous to provide that the sliding element is mounted in a sliding element holder in such a way that it can be moved, and that a contour of the sliding element holder is part of the profile.

The contour of the sliding element holder contained in the profile substantially corresponds to an actual contour of the sliding element holder that can be detected by the profile sensor, wherein deviations may occur as described above. In particular, the contour comprises a surface of the sliding element holder facing the profile sensor. The sliding element holder may have one or more additional contours which, for example, face away from the profile sensor or are covered by a packaging element or another component of the packaging machine and are therefore not detectable by the profile sensor. "Part of the profile" also means here that at least one area or portion or fragment of the profile is the contour of the sliding element holder.

The sliding element can be moved along its central axis in a sliding element receptacle provided in the sliding element holder. The sliding element is preferably moved by a hydraulic or pneumatic drive. If the sliding element is designed as a ram, the sliding element holder is designed as a ram holder. Preferably, several sliding elements are mounted on the sliding element holder in a displaceable manner. The several sliding elements are then preferably arranged in a row next to each other. The number and arrangement of the sliding elements preferably corresponds to the number and arrangement of receptacles on the holding element.

At least one reference surface is preferably defined on the sliding element holder, which can be detected by the profile sensor and is preferably stored in the control unit, in particular in its memory unit. The at least one reference surface is preferably defined on an intermediate piece between two sliding elements of the sliding element holder or on an end piece of the sliding element holder adjacent to a sliding element.

The at least one reference surface serves, for example, to determine a distance or height between a surface on the sliding element, in particular an end surface of the sliding element, and the reference surface on the sliding element holder. The at least one reference surface can then be used by the control unit when evaluating the profile, for example to determine an (actual) distance between the reference surface on the sliding element holder and the surface on the sliding element. In this way, for example, the (actual) position of the sliding element can be determined. The at least one reference surface can also be used when defining the stored (target) profile to define a maximum (target) distance and/or minimum (target) distance between the reference surface and the surface on the sliding element. The (target) distance is also referred to as the reference height. A reference window is defined between the maximum (target) distance and the minimum (target) distance, within which the sliding elements must be arranged so that a first packaging element can be found to be present and/or the (actual) position of the first packaging element can be found to be correct.

As described above, the presence and/or absence and/or position of the first packaging element has an effect on the position of the sliding element in the sliding element holder. The respective position of the sliding element in turn has an effect on the contour that can be detected by the profile sensor and thus on the profile of which both the sliding element and the sliding element holder are part. Since the profile is thus representative of the presence and/or absence and/or position of the first packaging element, the presence and/or absence and/or position of the first packaging element can be indirectly determined from the position of the sliding element relative to the sliding element holder.

In a particularly advantageous manner, the profile sensor is arranged above (in particular vertically above) the holding element and/or the sliding element and/or the sliding element holder.

The profile sensor is preferably arranged above the holding element and/or the sliding element and/or the sliding element holder in such a way that the sensor signal emitted by the profile sensor is perpendicular to a plane in which the at least one first packaging element is arranged in the holding element, in particular in one of its receptacles, and/or the sliding element is arranged in the sliding element holder. In particular, the previously described surface of the first packaging element and/or the sliding element and/or the previously described reference surface of the holding element and/or the sliding element holder is arranged in the plane. The sensor signal of the profile sensor then preferably extends parallel to the central axis running through the receptacle and/or parallel to the central axis of the at least one sliding element.

Alternatively, the profile sensor may be arranged at a different angle to the holding element and/or the sliding element and/or the sliding element holder, for example if the profile sensor is intended to detect the profile during movement of the holding element and/or the sliding element and/or the sliding element holder. The profile sensor may alternatively or additionally be arranged laterally offset from the holding element and/or the sliding element and/or the sliding element holder.

In particular, the profile sensor is arranged in the vicinity of the supply unit on a side facing away from the supply unit and/or in the vicinity of the filling station on a side facing away from the nest. Such a close proximity is defined in particular by a direct, in particular immediate, proximity to the supply unit and/or filling station and differs in particular from an area of the packaging machine further away from the supply unit and filling station, in which the camera of a camera system known from the prior art is usually arranged.

The profile sensor is preferably arranged at such a distance from the holding element and/or the sliding element that a laminar flow over the first packaging element and/or the second packaging element is not influenced, in particular impaired, by the profile sensor.

In addition, a method for triggering a rejection process in a packaging machine according to the invention is described here, wherein the profile sensor detects the profile that is representative of the presence and/or absence and/or position of the first packaging element, and the control unit evaluates the detected profile and, based on this, provides at least one piece of information concerning the presence and/or absence and/or position of the first packaging element, and wherein, based on this at least one piece of information provided, preferably by means of the control unit, a control command for the rejection process is generated.

It should be noted that the particular advantages and design features described in conjunction with the system and packaging machine described above are also applicable and transferable to the method described.

As part of the method according to the invention, the system according to the invention is first used to check whether a first packaging element stored as present is actually present and/or whether a first packaging element stored as absent is actually absent and/or whether the (actual) position of a present first packaging element corresponds to a stored (target) position and/or to what extent the (actual) position of the present first packaging element deviates from the stored (target) position. A control command is then generated based on the result of this check. The control command is generated in particular if a first packaging element stored as present is absent or if the (actual) position of the present first packaging element does not correspond to the stored (target) position or deviates too far from the stored (target) position.

The method is preferably carried out (shortly) after the at least one first packaging element has been placed in the holding element. The profile sensor is preferably set up in such a way that the holding element is detected in the vicinity of the supply unit. This makes it possible to generate (and execute) the control command before the holding element would have to supply the at least one first packaging element at the filling station.

The method is preferably carried out alternatively or additionally before and/or during the displacement of the first packaging elements or the insertion of the first packaging elements into the second packaging elements.

In a particularly advantageous manner, the control command for the rejection process involves removing the first packaging element from the holding element and/or marking the second packaging element.

The rejection can therefore be the rejection of a first packaging element and/or the rejection of a second packaging element.

The first packaging element is discarded and removed from the holding element in particular if it is not correctly positioned in the receptacle of the holding element, i.e. if the (actual) profile does not correspond to the stored (target) profile or deviates too far from it. When the first packaging element is rejected, the control command is then issued in particular to a device which is designed to remove the at least one first packaging element from the holding element. If a first packaging element stored as present is absent, all first packaging elements present in the holding element are preferably removed from the holding element, in particular by means of the device provided for this purpose. Such a procedure enables a comparatively simple design of a loading device at the supply unit. It may be provided that the holding element is then reloaded with first packaging elements, in particular at the supply unit.

The second packaging element is discarded in particular if no first packaging element has been provided for sealing the second packaging element. Due to a marking of the affected second packaging element, also referred to as a bad marking, it can then be separated out.

Advantageously, an evaluation by the control unit comprises determining a distance between a first level of the profile, preferably generated by a reference surface on the holding element or the sliding element holder, and a second level of the profile, preferably generated by a surface on the first packaging element or the sliding element.

The respective surface and respective reference surface were previously described in the context of the system and the packaging machine.

If the distance between the first level and the second level is greater or smaller than a predetermined distance, the control command for the rejection process is generated. It should be noted that the second level created by the surface on the sliding element can be influenced by the presence and/or absence and/or position of the first packaging element, so that the second level allows conclusions to be drawn about the presence and/or absence and/or position of the first packaging element.

The control command for the rejection process is preferably generated when the (actual) position of the at least one present first packaging element lies outside the reference window defined between the maximum (target) distance and the minimum (target) distance.

BRIEF DESCRIPTION OF THE DRAWINGS

The invention and the technical environment of the invention are explained in more detail below with reference to the figures. The figures show a preferred embodiment, to which the invention is not limited. It should be noted that the figures and the dimensions shown in the figures are only schematic. The following show by way of example and schematically.

DETAILED DESCRIPTION

Figure 1:
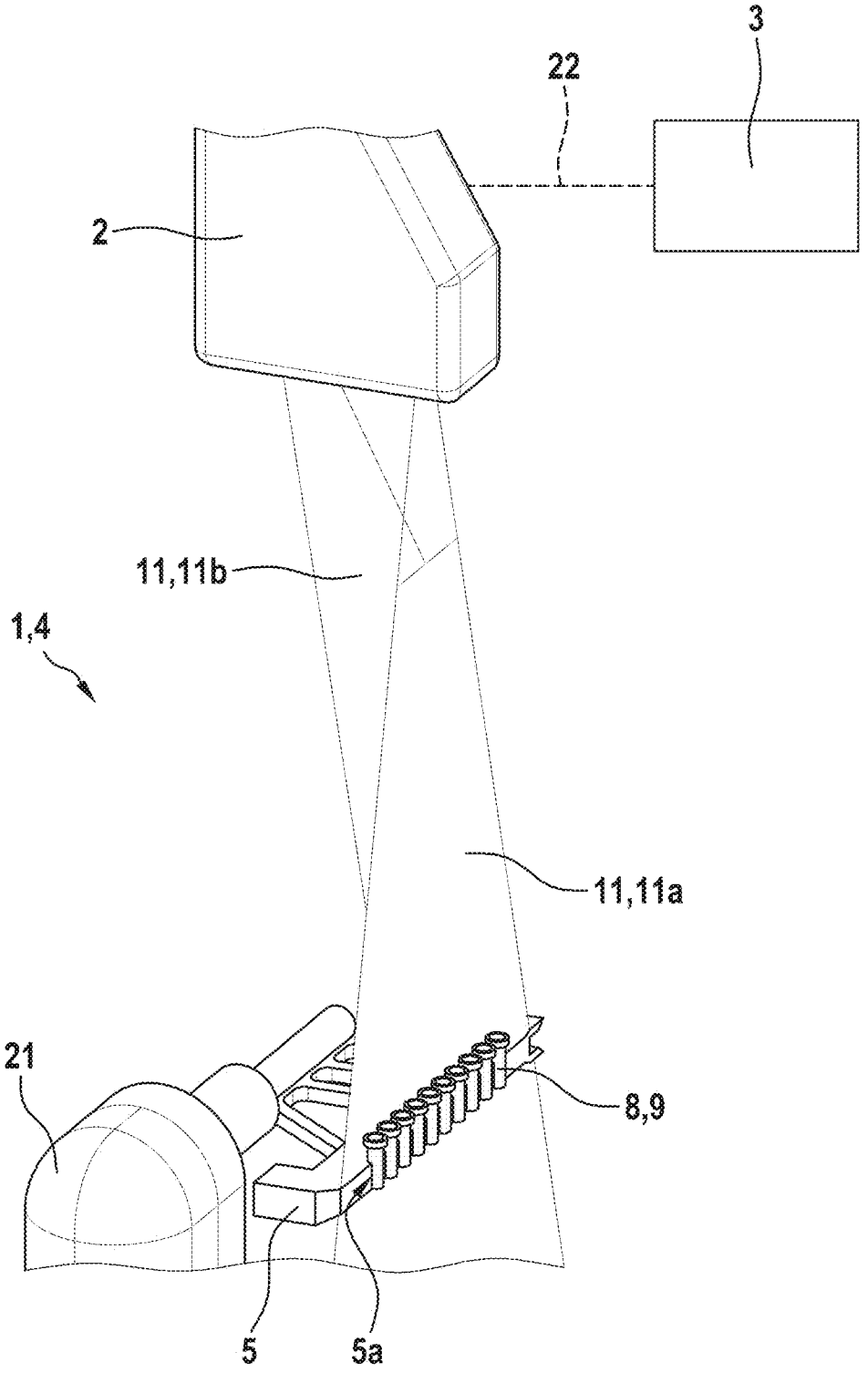
FIG. 1: a described packaging machine with a holding element and a described system.

FIG. 1 shows a described packaging machine 4 with a holding element 5 and a described system 1.

The system 1 is designed to detect the presence and/or absence and/or position of a first packaging element 8 and comprises a profile sensor 2 and a control unit 3 arranged separately from the profile sensor 2. The profile sensor 2 is connected to the control unit 3 via a data connection 22. The control unit 3 can receive data from the profile sensor 2 via such a data connection 22.

In the embodiment shown, the profile sensor 2 is a 2D profile sensor which emits a linear sensor signal 11. The emitted sensor signal 11*a* is reflected by components of the packaging machine 4, in particular the holding element 5 and the first packaging element 8 or their surfaces. The reflected signal 11*b* is received by the profile sensor 2. The profile sensor 2 operates using the light section method and is thus based on the principle of triangulation, wherein a receiving unit of the profile sensor 2, which is not shown, is arranged on the profile sensor 2 at a defined distance and angle to a transmitter unit of the profile sensor 2, which is also not shown.

The profile sensor 2 is arranged vertically above a holding element 5 of the packaging machine 4. The holding element 5 is a flat component provided with recesses, which can be moved by means of a kinematic mechanism 21. The holding element 5 has ten receptacles 5*a* and can therefore be equipped with a total of ten first packaging elements 8, which are designed as stoppers 9. At the time shown, the holding element 5 is actually equipped with ten first packaging elements 8. Alternatively, the holding element 5 may have more or fewer receptacles 5*a*. It may also be provided that, due to a specification made, for example, by the control unit 3, not each of the receptacles 5*a* is provided with a first packaging element 8 when the holding element 5 is loaded.

The profile sensor 2 can detect a profile 12 (see FIG. 5), wherein a contour of the holding element 5 and a contour of the first packaging elements 8 are each part 13 of the profile 12. The system 1 can thus be used to determine, via the profile 12 detected by the profile sensor 2, whether the respective first packaging element 8 is actually present in each receptacle 5*a* in which a first packaging element 8 is stored as present.

Figure 2:
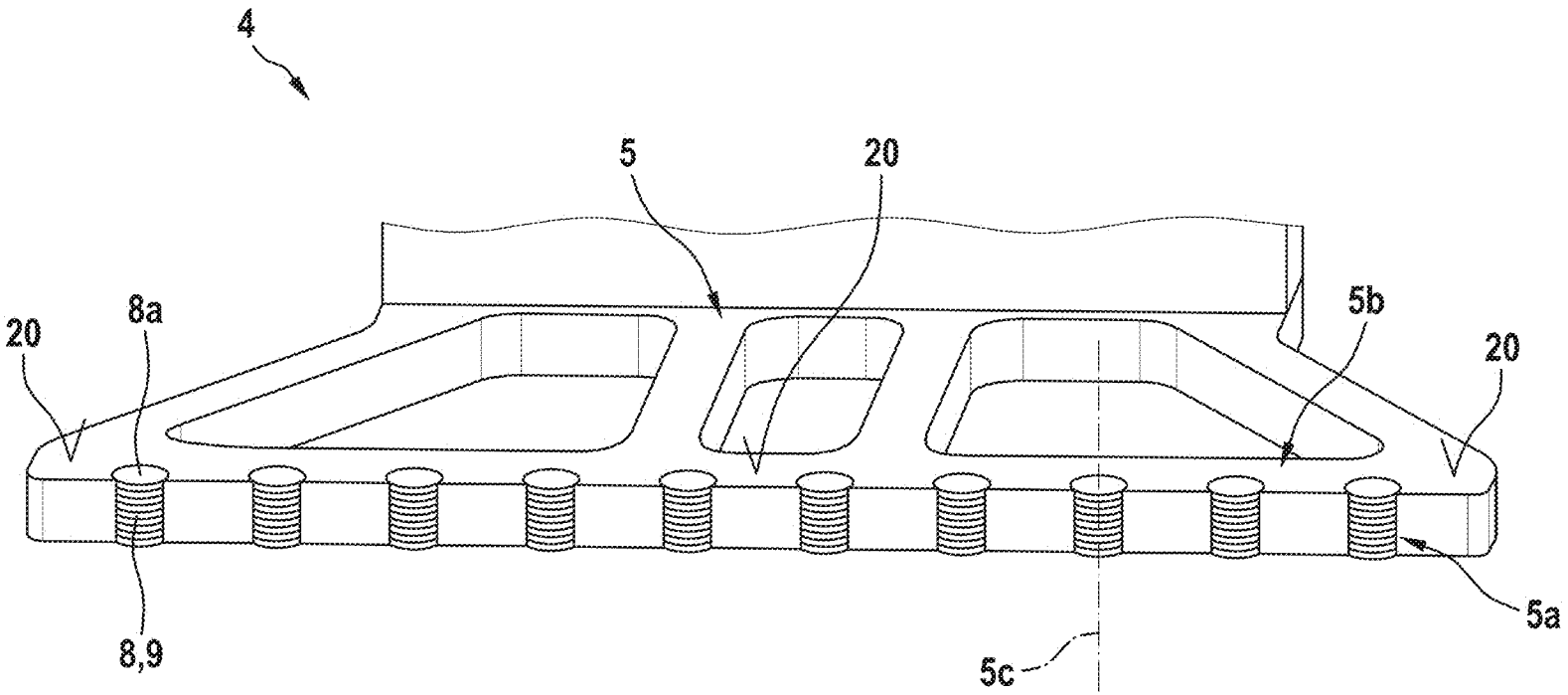
FIG. 2: a described packaging machine with a holding element.

FIG. 2 shows a described packaging machine 4 with a holding element 5.

This view clearly shows how the first packaging elements 8 are arranged in the holding element 5 or in the receptacles 5*a* of the holding element 5. It can also be seen that the first packaging elements 8 have a meandering structure on a surface in contact with the receptacle 5*a* of the holding element 5.

The holding element 5 has a surface 5*b* facing the profile sensor 2. A total of three reference surfaces 20 are defined on the holding element 5, in particular on the surface 5*b*. The reference surfaces 20 of the holding element 5 are arranged in a plane to which the sensor signal 11*a* emitted by the profile sensor 2 extends perpendicularly. The reference surfaces 20 can be used to check whether the first packaging elements 8 are arranged in a correct position in the holding element 5 or in the receptacle 5*a* of the holding element 5. For example, a distance between the reference surface 20 and an end face 8*a* on the first packaging element 8 can be determined for this purpose.

Figure 3:
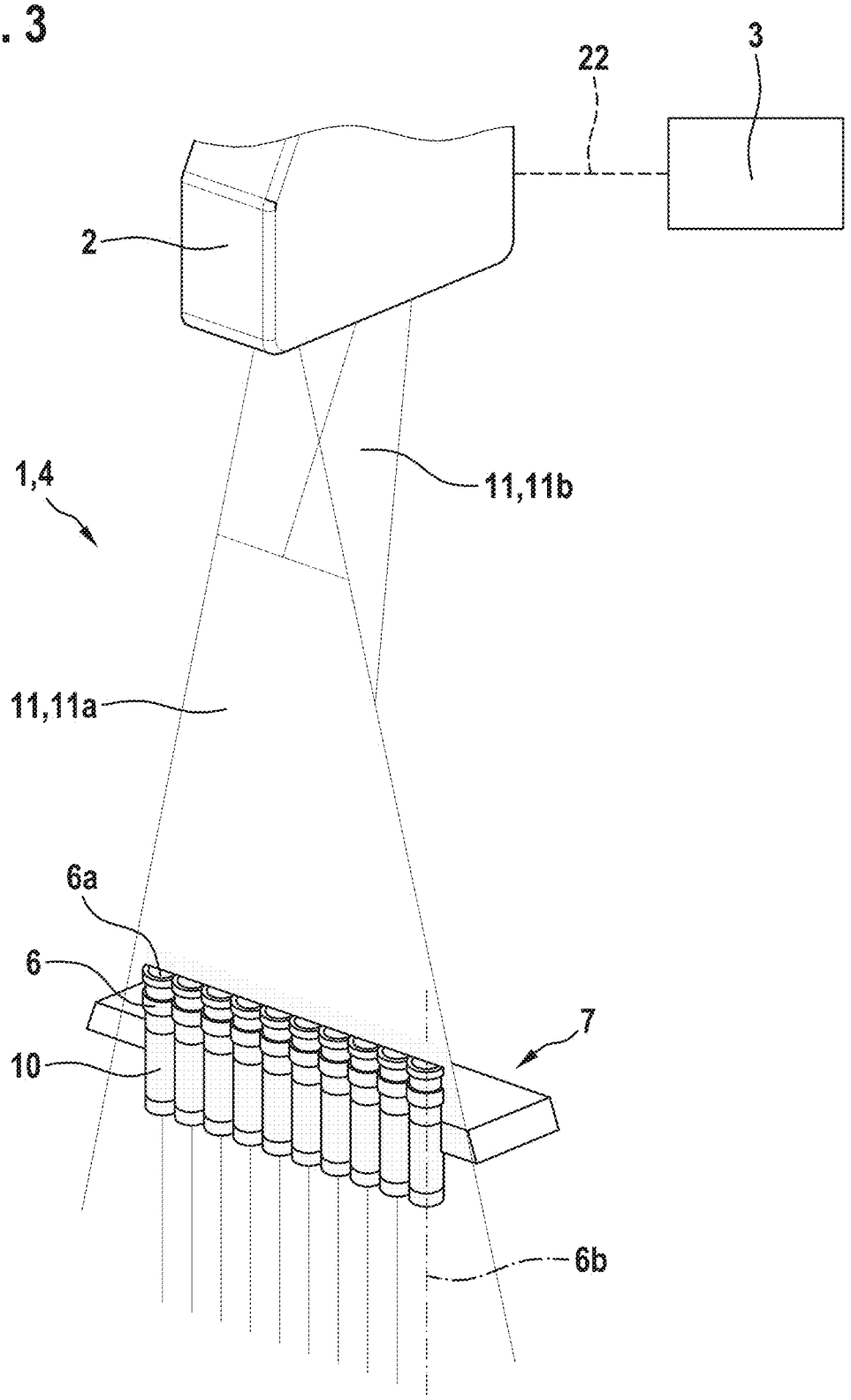
FIG. 3: a described packaging machine with a sliding element holder and the described system.

FIG. 3 shows a packaging machine 4 with a sliding element holder 7 and the system 1 described above.

In this variant, the profile sensor 2 is arranged vertically above a sliding element holder 7 and sliding elements 6 that can be moved therein. The sliding elements 6 are mounted so that they can slide along a central axis 6*b* of the sliding element 6 and are used to slide the first packaging elements 8 into second packaging elements 10. To do this, the sliding element holder 7 is placed over the first packaging elements 8 arranged above the second packaging elements 10.

With the sensor signal 11*a* emitted by the profile sensor 2, the sliding elements 6 and the sliding element holder 7 or a contour thereof can be detected by the profile sensor 2. In particular, an end face 6*a* can be detected on the sliding element 6. The sliding element holder 7 and the sliding elements 6 are each part 13 of the contour 12.

However, the first packaging elements 8 are concealed by the sliding elements 6, so that no contour of the first packaging elements 8 can be detected. However, the presence and/or absence and/or position of a first packaging element 8 has an effect on the position of the respective sliding element 6, so that a position of the respective sliding element 6 is representative of the presence and/or absence and/or position of the first packaging element 8.

Compared to the variant shown in FIG. 1, in the variant shown here, the system 1 can be used to determine, via a profile 12 detected by the profile sensor 2, whether the first packaging elements 8 can be correctly inserted into the second packaging elements 10 or have been inserted.

Figure 4:
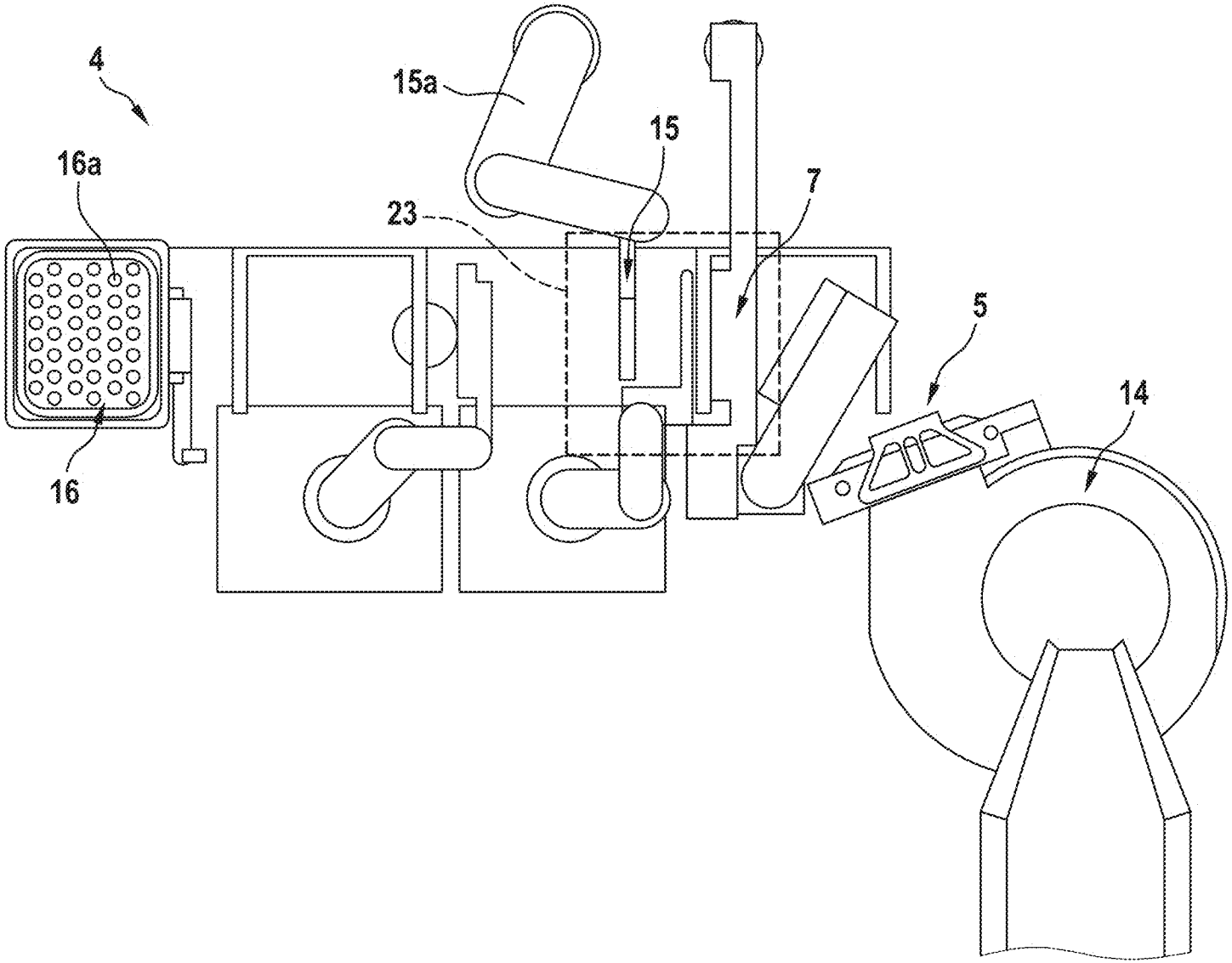
FIG. 4: a described packaging machine with a holding element, a sliding element holder, a supply unit and a nest.

FIG. 4 shows a described packaging machine 4 with a holding element 5, a sliding element holder 7, a supply unit 14 and a nest 16.

The first packaging elements 8 are provided at the supply unit 14. At the time shown, the holding element 5 is in a receiving position in which the first packaging elements 8 provided by the supply unit 14 can be received by the holding element 5.

The packaging machine 4 also has a filling station 23 at which the second packaging element 10, which is designed in particular as a disposable syringe, can be filled, in particular with a liquid pharmaceutical product. The holding element 5 can be moved to the filling station 23, in particular by means of the kinematic mechanism 21 shown in FIG. 1. A filling unit 15 for filling the second packaging elements 10 is provided at the filling station 23. The filling unit 15 can be moved in space by means of a robot arm 15*a*.

The nest 16 is designed to hold several second packaging elements 10. The nest 16 loaded with the second packaging elements 10 is moved to the filling station 23, but can also be moved within the filling station 23. After filling the second packaging elements 10 using the filling unit 15, the first packaging elements 8 are inserted into the second packaging elements 10. The sliding elements 6 mounted on the sliding element holder 7 shown are used for this purpose.

Figure 5:
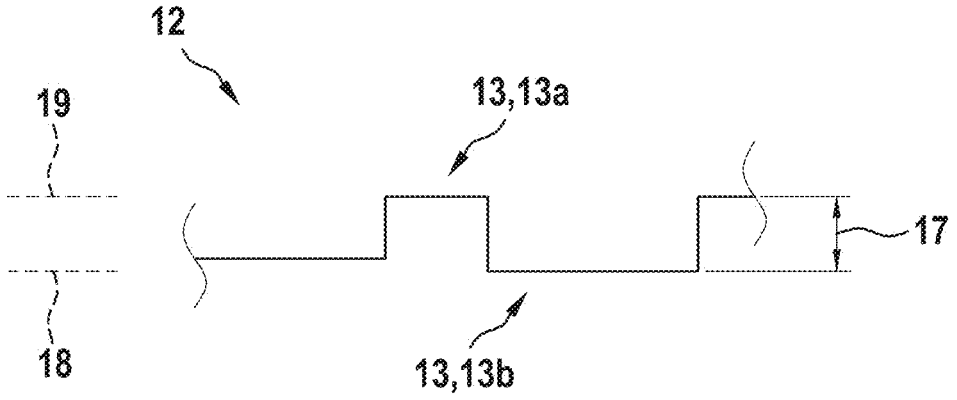
FIG. 5: a detail of a profile captured by a profile sensor.

FIG. 5 shows a detail of a profile 12 detected by a profile sensor 2.

The profile 12 is composed of several parts 13. Part 13*a* is a contour of a first packaging element 8 and part 13*b* is a contour of the holding element 5 in the region of a reference surface 20. The reference surface 20 creates a first level 18 of the profile 12 and the contour of a first packaging element 8 creates a second level 19 of the profile 12. The control unit 3 can determine a distance 17 between the first level 18 and the second level 19. Based on the distance 17, the control unit 3 can provide at least one piece of information concerning the presence and/or absence and/or position of the first packaging element 8.

LIST OF REFERENCE SIGNS

1 system
2 profile sensor
3 control unit
4 packaging machine
5 holding element
5*a* receptacle (holding element)
5*b* surface (holding element)
5*c* central axis receptacle (holding element)
6 sliding element
6*a* end surface (sliding element)
6*b* central axis (sliding element)
7 sliding element holder
8 first packaging element
8*a* end surface (first packaging element)
9 stopper
10 second packaging element
11 sensor signal
11*a* transmitted sensor signal
11*b* reflected sensor signal
12 profile
13 part (profile)
14 supply unit
15 filling unit
15*a* robot arm
16 nest
16*a* nest receptacle

17 distance
18 first level
19 second level
20 reference surface
21 kinematic mechanism (holding element)
22 data connection
23 filling station

The invention claimed is:

1. A packaging machine (4) comprising at least one system (1) for detecting the presence and/or absence and/or position of a first packaging element (8) in the packaging machine (4), comprising: a profile sensor (2) configured to detect a profile (12) that is representative of the presence and/or absence and/or position of the first packaging element (8), and a control unit (3) configured to evaluate the profile (12) detected by the profile sensor (2) and to provide at least one piece of information concerning the presence and/or absence and/or position of the first packaging element (8), wherein the packaging machine (4) comprises at least one holding element (5) for holding the first packaging element (8), and/or a sliding element (6) for moving the first packaging element (8), wherein a contour of the at least one holding element (5) and/or a contour of the sliding element (6) is part (13) of the profile (12).

2. The packaging machine (4) according to claim 1, wherein the first packaging element (8) is a closure element.

3. The packaging machine according to claim 2, wherein the closure element is a stopper (9).

4. The packaging machine (4) according to claim 1, wherein a contour of the first packaging element (8) is part (13) of the profile (12).

5. The packaging machine (4) according to claim 1, wherein the profile sensor (2) is a 2D profile sensor and a sensor signal (11) emitted by the profile sensor (2) is linear.

6. The packaging machine (4) according to claim 1, wherein the profile sensor (2) is a 3D profile sensor and a sensor signal (11) emitted by the profile sensor (2) is multi-line.

7. The packaging machine according to claim 6, wherein the multi-line sensor signal (11) is grid-shaped.

8. The packaging machine (4) according to claim 1, wherein a sliding element is arranged for inserting the first packaging element (8) into a second packaging element (10).

9. The packaging machine (4) according to claim 1, wherein the sliding element (6) is mounted in a sliding element holder (7) such that it can be moved, and a contour of the sliding element holder (7) is part (13) of the profile (12).

10. The packaging machine (4) according to claim 1, wherein the profile sensor (2) is arranged above the at least one holding element (5) and/or the sliding element (6) and/or a sliding element holder (7).

11. A method for triggering a rejection process in a packaging machine (4) according to claim 1, wherein the profile sensor (2) detects the profile (12) which is representative of the presence and/or absence and/or position of the first packaging element (8), and the control unit (3) evaluates the detected profile (12) and provides at least one piece of information concerning the presence and/or absence and/or position of the first packaging element (8), and wherein, based on this at least one piece of information provided, a control command for the rejection process is generated.

12. The method according to claim 11, wherein the control command for the rejection process includes removing the first packaging element (8) from the at least one holding element (5) and/or marking the second packaging element (10).

13. The method according to claim 11, wherein an evaluation by the control unit (3) determines a distance (17) between a first level (18) of the profile (12) and a second level (19) of the profile (12).

14. The method according to claim 13, wherein the first level is measured from a reference surface on the at least one holding element (5) or the sliding element holder (7), and wherein the second level is measured from a surface on the first packaging element (8) or the sliding element (6).

* * * * *